US006427652B2

(12) United States Patent
Faria et al.

(10) Patent No.: US 6,427,652 B2
(45) Date of Patent: Aug. 6, 2002

(54) SWITCHABLE FLAT OR ROLLER TAPPET

(75) Inventors: Christof Faria, Erlangen; Oliver Schnell, Veitsbronn, both of (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/760,863

(22) Filed: Jan. 16, 2001

(30) Foreign Application Priority Data

Jan. 20, 2000 (DE) ..... 100 02 287

(51) Int. Cl.[7] ..... F01L 1/14
(52) U.S. Cl. ..... 123/90.16; 123/90.5; 123/198 F
(58) Field of Search ..... 123/90.15, 90.16, 123/90.48, 90.49, 90.5, 90.55, 198 F

(56) References Cited

U.S. PATENT DOCUMENTS

| | | | | | |
|---|---|---|---|---|---|
| 5,402,756 | A | * | 4/1995 | Bohme et al. | 123/90.16 |
| 5,655,487 | A | * | 8/1997 | Maas et al. | 123/90.16 |
| 5,934,232 | A | * | 8/1999 | Greene et al. | 123/90.16 |
| 6,164,255 | A | * | 12/2000 | Maas et al. | 123/90.16 |
| 6,196,175 | B1 | * | 3/2001 | Church | 123/90.16 |
| 6,247,433 | B1 | * | 6/2001 | Faria et al. | 123/90.16 |
| 6,257,185 | B1 | * | 7/2001 | Groh et al. | 123/90.16 |

FOREIGN PATENT DOCUMENTS

| | | |
|---|---|---|
| DE | 4302877 | 8/1994 |
| DE | 4324756 | 2/1995 |
| DE | 19540038 | 4/1997 |
| DE | 19622174 | 6/1997 |
| DE | 19642718 | 4/1998 |
| DE | 19652180 | 6/1998 |
| DE | 19652677 | 6/1998 |
| DE | 19801701 | 7/1999 |
| DE | 19804952 | 8/1999 |
| EP | 0685634 | 12/1995 |

* cited by examiner

*Primary Examiner*—Weilun Lo
(74) *Attorney, Agent, or Firm*—Bierman, Muserlian and Lucas

(57) ABSTRACT

The invention proposes a switchable roller tappet (1) for transmitting a cam lift to a push rod. According to the invention, the inner and the outer rotation-preventing devices of the tappet are made as a single component (17). This component is arranged in a reception (13) of the inner element (4), which reception also serves to lodge a coupling means (24). A tappet (1) of this type can be economically manufactured.

9 Claims, 1 Drawing Sheet

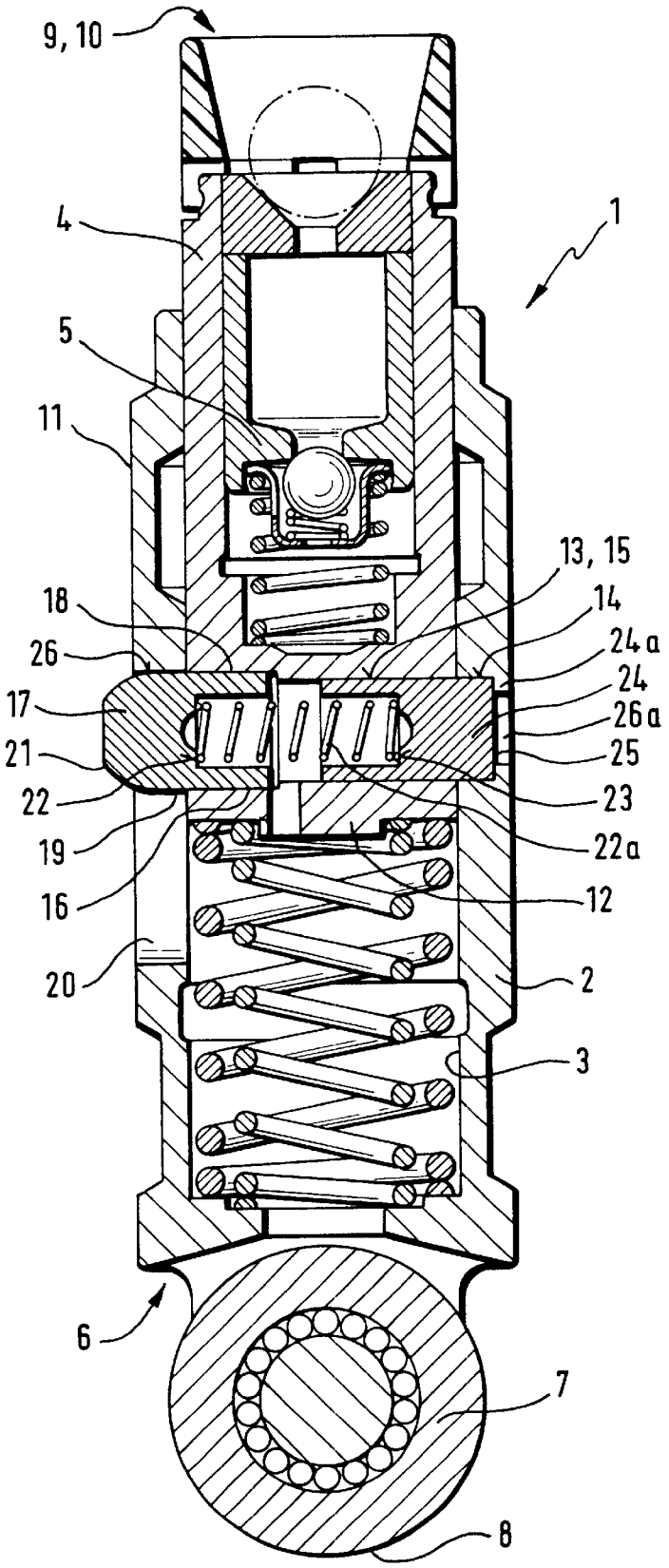
9, 10
1
4
5
11
13, 15
14
18
24a
26
24
17
26a
21
25
22
23
19
22a
16
12
20
2
3
6
7
8

SWITCHABLE FLAT OR ROLLER TAPPET

FIELD OF THE INVENTION

The invention concerns a switchable flat or roller tappet for transmitting a cam lift to a push rod in a valve train of an internal combustion engine, said tappet comprising a housing which can be mounted with an outer peripheral surface in a bore of the internal combustion engine, said housing comprising an axially extending cavity in which an inner element that is longitudinally displaceable relative to the housing is inserted, each of the housing and the inner element comprising at least one reception for at least one coupling means, said receptions being aligned to each other in a relative position for which the coupling means can be displaced so as to extend partially in each of said receptions for coupling the housing to the inner element, a first body being arranged between the housing and the inner element to positively prevent a rotation of the inner element relative to the housing, and a second body being arranged on the outer peripheral surface of the housing to positively prevent a rotation of the housing relative to the bore of the internal combustion engine.

BACKGROUND OF THE INVENTION

U.S. Pat. No. 5,361,733 discloses a tappet of the pre-cited type that is considered to be generic.

FIGS. 2, 4*a* of this patent show a tappet whose one end is associated to a group of cams and acts in the region of its other end directly on an end of a push rod. In the embodiment of FIG. 2, a rotation of the housing relative to the displaceable inner element is prevented by a pin that is fixed in the housing and extends radially inward into a longitudinal groove of an inner element that is surrounded by the housing. On the one hand, the pin prevents a rotation of the housing relative to the inner element and serves on the other hand as an upper axial stop for the inner element relative to the housing.

A separate rotation-prevention device for the housing relative to its bore in the internal combustion engine or in a component associated to the internal combustion engine is disclosed in the embodiment of FIG. 4*a*. The axle pins of this roller tappet extend radially outward beyond the housing. The protruding parts of the axle pins serve to prevent a rotation of the housing relative to the surrounding bore.

A drawback of the aforesaid tappet is that its inner and outer rotation-preventing measures are relatively complex. The need for two separate components unnecessarily increases costs and assembly work.

OBJECTS OF THE INVENTION

It is an object of the invention to create a tappet of the pre-cited type that is free of the mentioned drawbacks.

This and other objects and advantages of the invention will become obvious from the following detailed description.

SUMMARY OF THE INVENTION

The invention achieves the above objects in a tappet of the initially cited type by the fact that the first and the second body are made as a single component that is fixed in one of the inner element and the housing, a portion of the component extends into an opposing slot of the other of the inner element and the housing, said slot being positioned so as to form together with said portion of the component an upper stop for defining the relative position.

Thus, one single component, which in a first embodiment of the invention is made as a piston, serves both as an inner and an outer rotation-preventing device in the tappet. This unification of the otherwise two separate rotation-preventing devices in a single component simplifies the assembly of the tappet and at the same time reduces the overall costs.

In a preferred embodiment of the invention, the component extends in the reception of the inner element that at the same time serves as a reception for the coupling means. The scope of the invention extends also to solutions in which the component is arranged at a different height level from the reception of the inner element or of the housing. It is also possible to arrange the component fixedly in the housing in which case the slot is provided in the inner element.

If the reception in the inner element is made as a throughbore, an inner end of the component can serve as a support for one end of a compression spring whose opposing end acts on the coupling means for effecting coupling. Thus separate supporting measures for the compression spring can be dispensed with. The tappet is configured so that coupling is achieved by the spring force of the compression spring and uncoupling, through hydraulic medium conducted to an outer end of the coupling means. It is also conceivable to reverse this principle or to apply hydraulic medium pressure to both ends of the coupling means.

To limit the travel of the coupling means in radially outward direction for effecting coupling, it is proposed to make the reception for the coupling means in the housing with a stepped configuration so that the coupling means is stopped on the thus implemented diameter reduction.

According to an advantageous feature of the invention, a hydraulic clearance compensation element is installed within the tappet so that known mechanical adjusting measures are not required in the valve train.

According to a further proposition of the invention, the tappet is configured as a disconnectable tappet. For this, the housing comprises a contacting surface for only one cam. However, the invention can be equally well used in tappets cooperating with variable lift cams as discussed in connection with the prior art cited above.

The invention also proposes a particularly low-friction cam contact realized by the fact that the cam-proximate end of the housing comprises a roller. This roller can be mounted through a rolling or a sliding bearing.

According to a final proposition of the invention, an outer portion (end) of the one-piece component which, to prevent a rotation of the entire tappet, can be arranged in a longitudinal groove of the bore that surrounds the tappet, has a crowned configuration. However, it is also within the scope of the invention to make this outer portion cylindrical in shape with an axial line of this cylinder extending parallel to the longitudinal axis of the tappet. This has the advantage that the contact of the outer portion with the longitudinal groove is a linear contact and this reduces Hertzian stress. The cylinder may be made as a separate element and be connected to the component, for example, by gluing, but it can also be an integral part of the component.

BRIEF DESCRIPTION OF THE DRAWING

The invention will now be described more closely with reference to the drawing. The sole FIGURE shows a tappet of the invention in longitudinal cross-section.

DETAILED DESCRIPTION OF THE DRAWING

The FIGURE discloses a disconnectable tappet 1. This is made in the present case as a roller tappet and can be installed in a valve train of an internal combustion engine having a bottom or a side camshaft and a push rod.

The tappet 1 comprises a hollow cylindrical housing 2 in whose cavity 3 a slidable inner element 4 is mounted. The inner element 4 comprises a hydraulic clearance compensation element 5. One end 6 of the housing 2 comprises a roller 7 which serves as a direct contacting surface 8 for a cam of a camshaft, not shown. An end 9 of the inner element 4 situated opposite the end 6 protrudes from the housing 2 in a direction away from the cam. This end 9 comprises a support 10 for an end of a push rod, not shown.

The housing 2 is slidably mounted by an outer peripheral surface 11 in a bore of the internal combustion engine or of a component connected to the internal combustion engine.

A reception 13 is arranged in a region of a bottom 12 of the inner element 4 opposing the end 6 of the housing 2. In the present embodiment, this reception 13 is a diametrically extending bore. A further reception 14 in the housing 2 aligns to the reception 13 in a defined relative position of the inner element 4 to the housing 2. The reception 14 is likewise configured as a bore. The said relative position of the inner element 4 to the housing 2 is reached in the uncoupled state of the tappet, as a rule, in a base circle contact phase of the cam.

A piston-like component 17 is fixed with an inner portion 18 on an end 16 of the reception 13 of the inner element 4 opposite an end 15 of the reception 13. A central portion 19 of the piston-like component 17 extends in a slot 20 of the housing 2. An outer portion 21 of the component 17 extends beyond the outer peripheral surface 11 of the housing 2 and, in the present embodiment, has a crowned configuration. However, it may also have a cylindrical shape as already elaborated in the discussion of advantages of the invention.

One end of a compression spring 22a is supported on an inner end 22 of the component 17. The other end of the compression spring acts on a coupling means 24 configured in the present embodiment as a piston. Thus, in the uncoupled state of the tappet 1, the coupling means 24 extends entirely within the end 15 of the reception 13. In the coupled state shown in the FIGURE, the coupling means 24 extends into the reception 14 of the housing 2 and bears against a stop 24a formed in the reception 14. Hydraulic medium can be conducted to an outer end 25 of the coupling means 24 through a passage 26a in the housing 2. This hydraulic medium serves to displace the coupling means 24 from its shown coupling position into its uncoupling position in the reception 13.

The aforesaid component 17 serves a double purpose. As already mentioned, it extends with its central portion 19 into the slot 20 whose axial dimension corresponds at least to the lift of the cam. A cam-distal end of the slot 20 defines an upper stop 26 for the central portion 19 of the component 17. By this upper stop 26, an aligned relative position of the receptions 13, 14 to each other is realized. On the other hand, a rotation of the inner element 4 relative to the housing 2 is prevented by the fact that the component 17 extends into the slot 20.

The component 17 further prevents a rotation of the entire tappet 1 relative to the surrounding bore of the internal combustion engine. This is realized by its outer portion 21 which, in the installed state of the tappet 1, extends in a complementary longitudinal groove of the bore surrounding the tappet 1.

Thus, with the help of simple means, a double-action rotation-prevention device is created for the tappet 1, which in the discussed prior art is only realized by a plurality of elements. By using the reception 13 for the coupling means 24 for simultaneously fixing the component 17, a further advantage of minimization of construction work in the tappet 1 is also obtained. It is, however, also conceivable to provide a separate reception for the component 17 in the tappet 1.

What is claimed is:

1. A switchable flat or roller tappet for transmitting a cam lift to a push rod in a valve train of an internal combustion engine, said tappet comprising a housing which can be mounted with an outer peripheral surface in a bore of the internal combustion engine, said housing comprising an axially extending cavity in which an inner element that is longitudinally displaceable relative to the housing is inserted, each of the housing and the inner element comprising at least one reception for at least one coupling means, the coupling means is configured as a piston and installed in a second end of the reception in the inner element, and, in the relative position, the reception in the housing, which is also made as a bore, is situated opposite the coupling means, said receptions being aligned to each other in a relative position for which the coupling means can be displaced so as to extend partially in each of said receptions for coupling the housing to the inner element, a first body being arranged between the housing and the inner element to positively prevent a rotation of the inner element relative to the housing, and a second body being arranged on the outer peripheral surface of the housing to positively prevent a rotation of the housing relative to the bore of the internal combustion engine, characterized in that the first and the second body are made of a single piston component that is fixed in one of the inner element and the housing, a portion of the single component extends into an opposing slot of the other of the inner element and the housing, said slot being positioned so as to form together with said portion of the component an upper stop for defining the relative position, the reception in the inner element is made as a throughbore that extends diametrically or as a secant, the component and the coupling means are made as pistons with at least nearly the same diameter and at least one compression spring extends in a reception in the inner element, one end of the compression spring in the inner element is supported on the inner ends of the component which is a pocket bore and a lost-motion spring in the housing cavity axially dispersed between the bottom of the inner element and the ground of the cavity near a roller.

2. A tappet of claim 1 wherein the outer portion of the component extending beyond the outer peripheral surface of the housing has a crowned configuration.

3. A tappet of claim 1 wherein the outer portion of the component extending beyond the outer peripheral surface of the housing has a cylindrical configuration having an axial line parallel to a longitudinal axis of the tappet.

4. A tappet of claim 1 wherein a second end of the compression spring is supported on an inner end of the coupling means, the reception for the coupling means in the housing is intersected by a passage for hydraulic medium that can be conducted to an outer end of the coupling means for a complete displacement of the coupling means into the reception in the inner element.

5. A tappet of claim 4 wherein the reception for the coupling means in the housing comprises, radially outward, a stop for the coupling means.

6. A tappet of claim 1 wherein a hydraulic clearance compensation element is installed in the inner element.

7. A tappet of claim 1 wherein the tappet can be completely disconnected from cam lift.

8. A tappet of claim 7 wherein a cam-proximate end of the housing comprises a contacting surface for only one cam, and an end of the inner element opposed to said end of the housing possesses a support for the push rod.

9. A tappet of claim 8 wherein the cam-proximate end of the housing comprises the roller on which the contacting surface is formed.

* * * * *